US005535977A

United States Patent [19]

Poeshty

[11] Patent Number: 5,535,977

[45] Date of Patent: Jul. 16, 1996

[54] SUPPORTING STRUCTURE TO MOUNT AND HOLD CYLINDRICAL SHAPED ELEMENT

[76] Inventor: K. Andrew Poeshty, 3225 Parkside Pl., Apt. 5-E, Bronx, N.Y. 10467

[21] Appl. No.: 492,842

[22] Filed: Jun. 20, 1995

[30] Foreign Application Priority Data

Jun. 22, 1994 [HU] Hungary ..... 17803/94

[51] Int. Cl.[6] ..... A47G 33/12

[52] U.S. Cl. ..... 248/524; 248/526

[58] Field of Search ..... 248/519, 523, 248/524, 525, 526; 47/40.5

[56] References Cited

U.S. PATENT DOCUMENTS

| | | | |
|---|---|---|---|
| 1,714,498 | 5/1929 | Danner | 248/524 |
| 2,459,533 | 1/1949 | Irvin | 47/40.5 |
| 2,679,994 | 6/1954 | Mellen | 248/526 X |
| 3,885,763 | 5/1975 | Blom . | |
| 4,261,138 | 4/1981 | St. George Syms | 248/523 X |
| 4,313,588 | 2/1982 | Sjostrand . | |
| 4,565,028 | 1/1986 | Stephan . | |
| 4,571,882 | 2/1986 | Capen . | |

FOREIGN PATENT DOCUMENTS

| | | | |
|---|---|---|---|
| 2042 | 11/1877 | Germany | 248/524 |
| 158561 | 2/1933 | Switzerland | 248/524 |

*Primary Examiner*—Alvin O. Chin-Shue

*Assistant Examiner*—Derek J. Berger

*Attorney, Agent, or Firm*—Richard L. Miller

[57] ABSTRACT

A cylindrical shaped element supporting structure that includes an inverted vertically arranged hollow open top frustum-shaped container, knurling circumferentially disposed on the outer surface of the inverted vertically arranged hollow open top frustum-shaped container, at least three supporting stand legs vertically slidably mounted to the inverted vertically arranged hollow open top frustum-shaped container, and at least three crescent-shaped locking levers each of which being vertically pivotally mounted to a respective one of the at least three supporting stand legs. When the cylindrical shaped element is placed in the inverted vertically arranged hollow open top frustum-shaped container the weight of the cylindrical shaped element causes the inverted vertically arranged hollow open top frustum-shaped container to slide downwardly along the at least three supporting stand legs. The at least three crescent-shaped locking levers pivot upwardly allowing the lower end of each of the at least three crescent-shaped locking levers to ride upwardly and outwardly on the inverted vertically arranged hollow open top frustum-shaped container outer surface. Each upper end of the at least three crescent-shaped locking levers contacts the cylindrical shaped element. The crescent-shaped locking lever lower ends engage the knurling and prevent the at least three crescent-shaped locking levers from further pivoting. The cylindrical shaped element is stabilized in a self-locking fashion.

18 Claims, 1 Drawing Sheet

Fig. 1
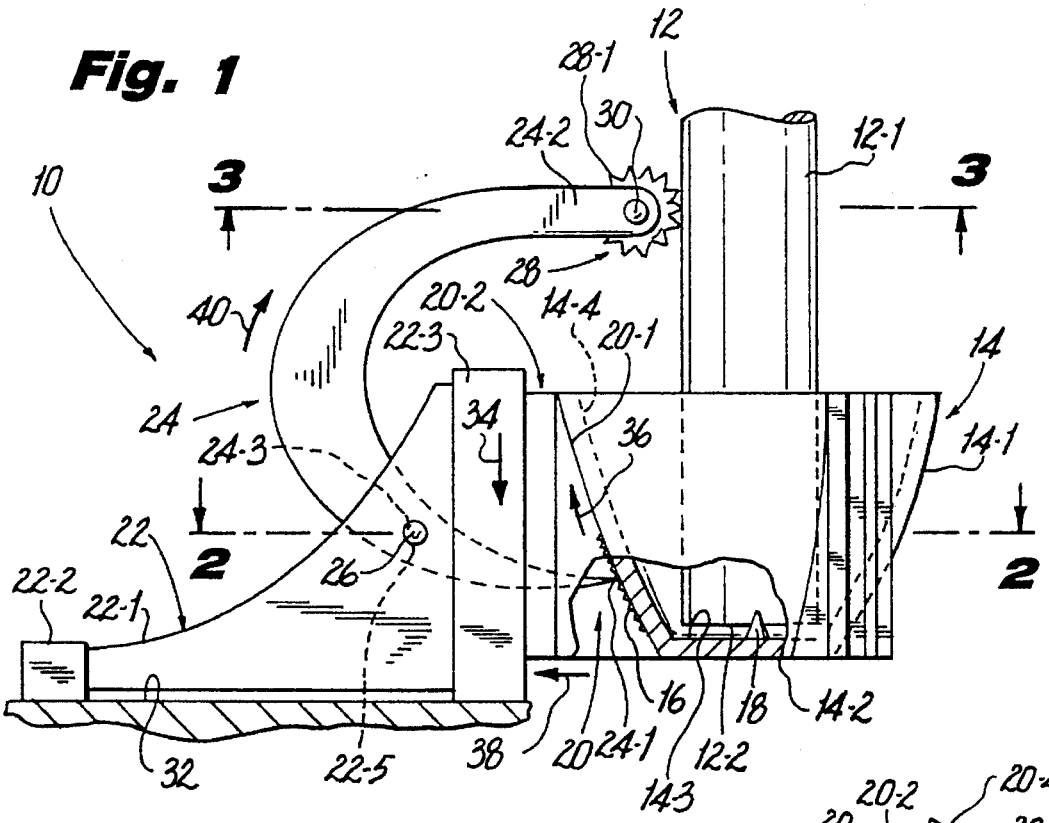
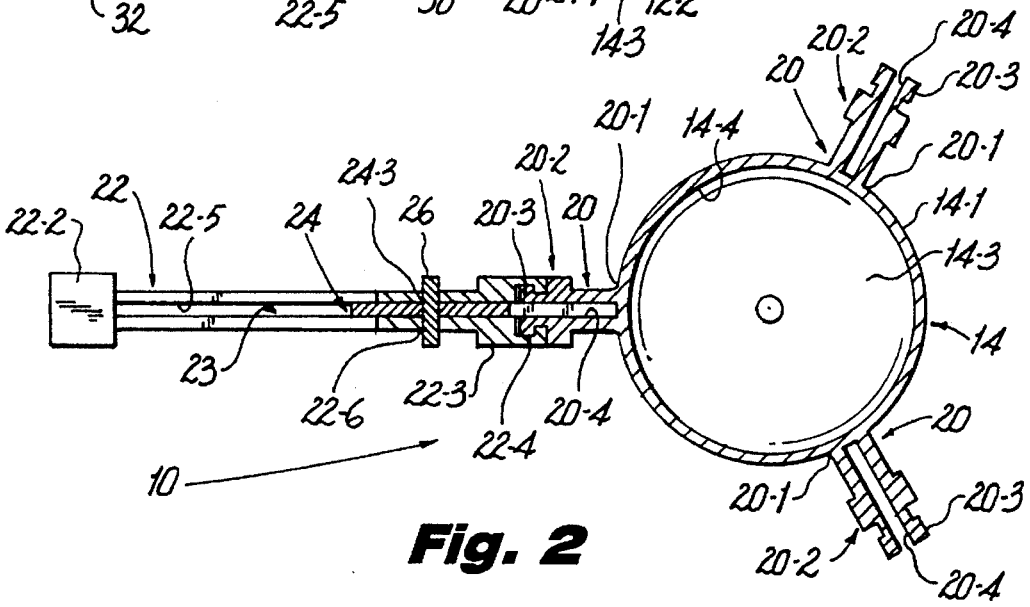
Fig. 2
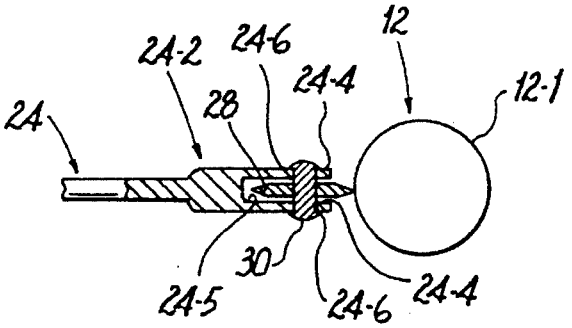
Fig. 3

SUPPORTING STRUCTURE TO MOUNT AND HOLD CYLINDRICAL SHAPED ELEMENT

CROSS REFERENCES

This application contains subject matter disclosed in applicant's HUNGARIAN application number P9401889 filed on Jun. 22, 1994, for which the benefits of foreign priority under Title 35 U.S.C, Sec. 119 is claimed.

BACKGROUND OF THE INVENTION

The present invention relates to a supporting structure to mount and hold cylindrical shaped elements. More particularly, the present invention relates to a supporting structure to mount and hold cylindrical shaped elements that includes an inverted vertically arranged hollow open top frustum-shaped container for receiving the cylindrical shaped element, knurling disposed on the outer surface of the container, at least three supporting stand legs vertically slidably mounted to the outer surface of the container, a crescent-shaped locking lever vertically pivotally mounted to each of the at least three supporting stand legs, a star-shaped locking element vertically rotatably mounted to the upper end of the crescent-shaped locking lever and communicating with the cylindrical shaped element, and a pawl disposed at the lower end of the crescent-shaped locking element and communicating with the knurling so that when the cylindrical shaped element is placed in the container the combined weight of the container and the cylindrical shaped element will cause the container to slide down the at least three supporting stand legs which in turn will cause the crescent-shaped locking levers to pivot upwardly as the pawl rides up the outer surface of the container until the star shaped locking element contacts and presses against the cylindrical shaped element at which time the pawl will engage a knurl and prevent the at least three crescent-shaped locking levers from further pivoting and stabilizing the cylindrical shaped element in a self-locking fashion.

At Christmas people are confronted in one way or another with the problem of providing the christmas tree with a base that is capable of maintaining the tree upright for several weeks. Christmas trees are very difficult to hold in a vertical position and their weight and length must be taken into account.

Conventional Christmas tree bases require a substantial amount of work to be carried out, either for adapting the wet, resiny, knotty and gnarled thick end of the tree to a round hole in a wooden cross by means of normally unsuitable edged tools, or for holding the tree upright while a helpmate is lying on the floor and tries to tighten three or four screws in order to prevent the tree from tilting over and falling out of the base of the stand. At the same time the center of gravity of the tree must be positioned within the support area of the base, otherwise both the tree and the base will tilt over. The effort required in both cases is substantial.

Another type of base is the three legged Christmas tree base. In this type of base the trunk of the Christmas tree is placed in the cylindrical part of the base and a wing nut is secured which presses and fastens the tree trunk against the surface of the supporting structure. This type of base does not provide adequate mounting to stabilize and prevent the tree from toppling over.

Still another type of base includes a wider base connected by stiffeners to increase stability. However, the varying features of the tree trunk can not accommodated for.

Numerous innovations for Christmas tree stands have been provided in the prior art that will be described. However, even though these innovations may be suitable for the specific individual purposes to which they address, they differ from the present invention in that they do not teach a Christmas tree base that includes an inverted vertically arranged hollow frustum-shaped open top container for receiving the tree trunk, knurling disposed on the outer surface of the container, at least three supporting stand legs vertically slidably mounted to the outer surface of the container, an arch-shaped locking lever vertically pivotally mounted to each of the at least three supporting stand legs, a star shaped locking element vertically rotatably mounted to the upper end of the crescent-shaped locking lever and communicating with the tree trunk, and a pawl disposed at the lower end of the crescent-shaped locking element and communicating with the knurling so that when the tree trunk is placed in the container, the weight of the tree will cause the container to slide down the at least three supporting stand legs which in turn will cause the crescent-shaped locking levers to pivot upwardly as the pawl rides up the outer surface of the container until the star shaped locking element contacts and presses against the tree trunk at which time the pawl will engage a knurl and prevent the at least three crescent-shaped locking levers from further pivoting and stabilizing the tree in a self-locking fashion.

For example, U.S. Pat. No. 3,885,763 to Blom teaches a supporting stand for Christmas trees that includes a tubular stand, a vertically arranged container having an internally disposed conical lower part and being slidably mounted within the stand, a spring biasing the container in the most upright inactive position, and at least three arms radially pivotally connected to the upper part of the stand.

Another example, U.S. Pat. No. 4,313,588 to Sjostrand teaches a Christmas tree base that includes a cross-shaped stand, a holder slidably mounted on each leg of the cross-shaped stand, a cam disc disposed at the center of the disc, and springs for drawing the holders to the center of the stand.

Finally, still another example, U.S. Pat. No. 4,571,882 to Capen teaches a Christmas tree stand that includes a stand, a pair of adjustable pawls disposed on the stand and forming a hemispherical cavity, a receptacle for the tree trunk having a hemispherical ball disposed on the bottom, and a plurality of machine screws provided on the receptacle for retaining the tree trunk.

It is apparent that numerous innovations for Christmas tree stands have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a supporting structure to mount and hold cylindrical shaped elements that avoids the disadvantages of the prior art.

Another object of the present invention is to provide a supporting structure to mount and hold cylindrical shaped elements that is simple and inexpensive to manufacture.

Still another object of the present invention is to provide supporting structure to mount and hold cylindrical shaped elements that is simple to use.

Yet another object of the present invention is to provide a supporting structure to mount and hold cylindrical shaped elements that holds and locks the trunk of a Christmas tree in a vertical position.

Still yet another object of the present invention is to provide a supporting structure to mount and hold cylindrical shaped elements that holds and locks any cylindrically shaped element in a vertical position.

Yet still another object of the present invention is to provide a supporting structure to mount and hold cylindrical shaped elements that holds and locks a flag pole.

Still yet another object of the present invention is to provide a supporting structure to mount and hold cylindrical shaped elements that negates the effects of wind on the flag pole.

Yet still another object of the present invention is to provide a supporting structure to mount and hold cylindrical shaped elements whose locking capability is directly proportional to the weight of the cylindrically shaped element and responsive to same.

Briefly stated, still yet another object of the present invention is to provide a supporting structure to mount and hold cylindrical shaped elements that includes an inverted vertically arranged hollow open top frustum-shaped container, knurling, at least three supporting stand legs, and at least three crescent-shaped locking levers.

Yet still another object of the present invention is to provide a supporting structure to mount and hold cylindrical shaped elements wherein the inverted vertically arranged hollow open top frustum-shaped container has an inverted vertically arranged hollow open top frustum-shaped container outer surface.

Still yet another object of the present invention is to provide a supporting structure to mount and hold cylindrical shaped elements wherein the knurling is circumferentially disposed on the inverted vertically arranged hollow open top frustum-shaped container outer surface.

Yet still another object of the present invention is to provide a supporting structure to mount and hold cylindrical shaped elements wherein the at least three supporting stand legs are vertically slidably mounted to the inverted vertically arranged hollow open top frustum-shaped container.

Still yet another object of the present invention is to provide a supporting structure to mount and hold cylindrical shaped elements wherein each of the at least three crescent-shaped locking levers is vertically pivotally mounted to a respective one of the at least three supporting stand legs.

Yet still another object of the present invention is to provide a supporting structure to mount and hold cylindrical shaped elements wherein each of the at least three crescent-shaped locking levers the has a crescent-shaped locking lever lower end that communicates with the knurling and a crescent-shaped locking lever upper end that communicates with a cylindrical shaped element.

Still yet another object of the present invention is to provide a supporting structure to mount and hold cylindrical shaped elements wherein the cylindrical shaped element supporting structure is injection molded from plastic.

Yet still another object of the present invention is to provide a supporting structure to mount and hold cylindrical shaped elements that further includes a securing tooth disposed in the inverted vertically arranged hollow open top frustum-shaped container.

Still yet another object of the present invention is to provide a supporting structure to mount and hold cylindrical shaped elements that still further includes at least three extension members vertically disposed on the inverted vertically arranged hollow open top frustum-shaped container outer surface and slidably connected to the at least three supporting stand legs.

Yet still another object of the present invention is to provide a supporting structure to mount and hold cylindrical shaped elements wherein each of the at least three extension members has an extension member arcuate-shaped inner edge that matches the inverted vertically arranged hollow open top frustum-shaped container outer surface, an vertically disposed extension member track portion tongue with flange, and contains a vertically disposed extension member slot.

Still yet another object of the present invention is to provide a supporting structure to mount and hold cylindrical shaped elements wherein the at least three extension members and the inverted vertically arranged hollow open top frustum-shaped container are integrally formed.

Yet still another object of the present invention is to provide a supporting structure to mount and hold cylindrical shaped elements wherein each of the at least three supporting stand legs has a supporting stand leg arcuate-shaped upper edge, a supporting stand leg outer block, a vertically disposed supporting stand leg track portion that contains a vertically disposed supporting stand leg track portion groove with recess that slidably receives the vertically disposed extension member track portion tongue with flange.

Still yet another object of the present invention is to provide a supporting structure to mount and hold cylindrical shaped elements wherein each of the at least three supporting stand legs further contains a vertically disposed supporting stand leg slot and a horizontally disposed supporting stand leg aperture.

Yet still another object of the present invention is to provide a supporting structure to mount and hold cylindrical shaped elements wherein each vertically disposed extension member slot and a respective vertically disposed supporting stand leg slot is a common slot.

Still yet another object of the present invention is to provide a supporting structure to mount and hold cylindrical shaped elements wherein each of the at least three crescent-shaped locking levers is vertically pivotally mounted within a respective common slot.

Yet still another object of the present invention is to provide a supporting structure to mount and hold cylindrical shaped elements wherein the crescent-shaped locking lever lower end is a sharp pawl.

Still yet another object of the present invention is to provide a supporting structure to mount and hold cylindrical shaped elements wherein the crescent-shaped locking lever upper end is a rounded pawl that has a pair of rounded pawl legs that are displaced a distance from each other and define an upper pawl slot therebetween.

Yet still another object of the present invention is to provide a supporting structure to mount and hold cylindrical shaped elements wherein the pair of rounded pawl legs contain aligned horizontally disposed rounded pawl leg apertures.

Still yet another object of the present invention is to provide a supporting structure to mount and hold cylindrical shaped elements that yet further includes a star wheel locking element that has star wheel locking element perimeter teeth and is vertically rotatably mounted within the upper pawl slot.

Yet still another object of the present invention is to provide a supporting structure to mount and hold cylindrical shaped elements that still yet further includes a star wheel rotating pin that passes through the aligned horizontally disposed rounded pawl leg apertures.

Still yet another object of the present invention is to provide a method of using a cylindrical shaped element supporting structure that includes the steps of placing manually the cylindrical shaped element supporting structure on a stationary surface, resting manually at least three vertically disposed supporting stand legs of the cylindrical shaped element supporting structure on the stationary surface, placing manually a cylindrical shaped element in an inverted vertically arranged hollow open top frustum-shaped container of the cylindrical shaped element supporting structure, resting manually the cylindrical shaped element bottom on a hollow frustum-shaped container bottom inner surface of the inverted vertically arranged hollow open top frustum-shaped container, entering automatically a securing tooth disposed on the cylindrical shaped element bottom inner surface into the cylindrical shaped element bottom by virtue of the weight of said cylindrical shaped element, sliding automatically downwardly a combination of the inverted vertically arranged hollow open top frustum-shaped container and at least three vertically disposed extension members of the cylindrical shaped element supporting structure on at least three vertically disposed supporting stand legs of the cylindrical shaped element supporting structure by virtue of the weight of the cylindrical shaped element, moving automatically upwardly and outwardly at least three lower locking lever sharp pawls of the cylindrical shaped element supporting structure by virtue of the upward increasing diameter of the inverted vertically arranged hollow open top frustum-shaped container, causing automatically at least three crescent-shaped locking levers of the cylindrical shaped element supporting structure to pivot upwardly by virtue of their integral formation with the at least three lower locking lever sharp pawls, pivoting automatically and continuously the at least three crescent-shaped locking levers until the star wheel locking element perimeter teeth of the cylindrical shaped element supporting structure contact the cylindrical shaped element, lodging automatically the at least three locking lever sharp pawls in knurling disposed on the outer surface of the inverted vertically arranged hollow open top frustum-shaped container, self-locking automatically the at least three crescent-shaped locking levers from further movement, and securing automatically the cylindrical shaped element in a stabilized position in the inverted vertically arranged hollow open top frustum-shaped container.

Yet still another object of the present invention is to provide a method of using a cylindrical shaped element supporting structure that further includes the step of adding a liquid in the inverted vertically arranged hollow open top frustum-shaped container.

Finally, still yet another object of the present invention is to provide a method of using a cylindrical shaped element supporting structure that still further includes the step removing one locking lever pivot pin of the cylindrical shaped element supporting structure after the securing step.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic side elevational view of the supporting structure to mount and hold cylindrical shaped elements of the present invention illustrating, for clarity purposes, only one of the at least three supporting stand legs and respective crescent-shaped locking lever;

FIG. 2 is a cross sectional view taken along line 2—2 of FIG. 1; and FIG. 3 is a cross sectional view taken along line 3—3 of FIG. 1.

LIST OF REFERENCE NUMERALS UTILIZED IN THE DRAWING

10 supporting structure to mount and hold cylindrical shaped elements of the present invention
12 cylindrical shaped element
12-1 cylindrical shaped element outer surface
12-2 cylindrical shaped element bottom
14 inverted vertically arranged hollow open top frustum-shaped container
14-1 hollow frustum-shaped container outer surface
14-2 hollow frustum-shaped container bottom 14-2
14-3 hollow frustum-shaped container bottom inner surface
14-4 hollow frustum-shaped container chamber
16 knurling
18 optional securing tooth
20 at least three vertically disposed extension members
20-1 vertically disposed extension member arcuate-shaped inner edge
20-2 vertically disposed extension member track portion
20-3 vertically disposed extension member track portion tongue with flange
20-4 vertically disposed extension member slot
22 at least three vertically disposed supporting stand legs
22-1 vertically disposed supporting stand leg arcuate-shaped upper edge
22-2 vertically disposed supporting stand leg outer block
22-3 vertically disposed supporting stand leg track portion
22-4 vertically disposed supporting stand leg track portion groove with recess
22-5 vertically disposed supporting stand leg slot
22-6 horizontally disposed supporting stand leg aperture
23 common slot
24 at least three crescent-shaped locking levers
24-1 locking lever lower end sharp pawl
24-2 locking lever upper end rounded pawl
24-3 horizontally disposed locking lever pivot aperture
24-4 pair of locking lever upper end rounded pawl legs
24-5 locking lever upper end rounded pawl slot
24-6 aligned horizontally disposed locking lever upper end rounded pawl leg aperture
26 readily removable locking lever pivot pin
28 star wheel locking element
28-1 star wheel locking element perimeter teeth
30 star wheel locking lever rotating pin
32 stationary surface
34 downward arrow
36 upward arrow
38 outward arrow
40 pivot arrow

DETAILED DESCRIPTION OF THE PREFERRED EMBODIMENT

Referring now to the figures, and particularly to FIG. 1, the supporting structure to mount and hold cylindrical shaped elements of the present invention is shown generally at 10 securing a cylindrical shaped element 12 that has a cylindrical shaped element outer surface 12-1 and a cylindrical shaped element bottom 12-2.

The configuration of the supporting structure to mount and hold cylindrical shaped elements 10 can best be seen in FIGS. 1–3, and as such, will be discussed with reference thereto.

The supporting structure to mount and hold cylindrical shaped elements 10 can be injection mold from plastic, but is not limited to that, and includes an inverted vertically arranged hollow open top frustum-shaped container 14 that has a hollow frustum-shaped container outer surface 14-1 with a hollow frustum-shaped container bottom 14-2, a hollow frustum-shaped container bottom inner surface 14-3, and contains a hollow frustum-shaped container chamber 14-4.

Knurling 16 is circumferentially disposed on a portion of the hollow frustum-shaped container outer surface 14-1 and an optional securing tooth 18 is disposed at the center of the hollow frustum-shaped container bottom inner surface 14-3.

Each of at least three vertically disposed extension members 20 has a vertically disposed extension member arcuate-shaped inner edge 20-1, a vertically disposed extension member track portion 20-2 with a vertically disposed extension member track portion tongue with flange 20-3, and contains a vertically disposed extension member slot 20-4. At least three vertically disposed extension members 20 have been chosen to assure stability.

The at least three vertically disposed extension members 20 may be integrally formed with the inverted vertically arranged hollow open top frustum-shaped container 14, but is not limited to that, or may be attached to the inverted hollow frustum-shaped container outer surface 14-1 at the vertically disposed extension member arcuate-shaped inner edge 20-1 whose contour matches that of the hollow frustum-shaped container outer surface 14-1.

Each of at least three vertically disposed supporting stand legs 22 is vertically slidably mounted to a respective one of the at least three vertically disposed extension member 20 and has a vertically disposed supporting stand leg arcuate-shaped upper edge 22-1, a vertically disposed supporting stand leg outer block 22-2, a vertically disposed supporting stand leg track portion 22-3 containing a vertically disposed supporting stand leg track portion groove with recess 22-4.

Each of the at least three vertically disposed supporting stand legs 22 further contains a vertically disposed supporting stand leg slot 22-5, and a horizontally disposed supporting stand leg aperture 22-6. The vertically disposed supporting stand leg slot 22-5 and the vertically disposed extension member slot 20-4 form a common slot 23.

Each of the at least three vertically disposed supporting stand legs 22 is vertically slidably mounted to the respective one of the at least three vertically disposed extension members 20 by virtue of the vertically disposed extension member track portion tongue with flange 20-3 and the vertically disposed supporting stand leg track portion groove with recess 22-4. The presence of the flange of the vertically disposed extension member track portion tongue with flange 20-3 and the presence of the recess of the vertically disposed supporting stand leg track portion groove with recess 22-4 provide an interlocking arrangement that prevents lateral separation.

Each of at least three crescent-shaped locking levers 24 is vertically pivotally mounted within the vertically disposed supporting stand leg slot 22-5 of a respective one of the at least three vertically disposed supporting stand legs 22 and includes a locking lever lower end sharp pawl 24-1 that communicates with the knurling 16, a locking lever upper end rounded pawl 24-2, and contains a horizontally disposed locking lever pivot aperture 24-3.

Each of the at least three crescent-shaped locking levers 24 is vertically pivotally mounted within the vertically disposed supporting stand leg slot 22-5 of a respective one of the at least three vertically disposed supporting stand legs 22 by a readily removable locking lever pivot pin 26 that passes through the horizontally disposed supporting stand leg aperture 22-6 and the aligned horizontally disposed locking lever pivot aperture 24-3.

The locking lever upper end rounded pawl 24-2 includes a pair of locking lever upper end rounded pawl legs 24-4 displaced a distance from each other and define a locking lever upper end rounded pawl slot 24-5 therebetween.

Each one of the pair of locking lever upper end rounded pawl legs 24-4 contain an aligned horizontally disposed locking lever upper end rounded pawl leg aperture 24-6.

A star wheel locking element 28 communicates with the cylindrical shaped element 12 and has star wheel locking element perimeter teeth 28-1. The star wheel locking element 28 is vertically rotatably mounted within the locking lever upper end rounded pawl slot 24-5 by a star wheel locking lever rotating pin 30 that passes through each aligned horizontally disposed locking lever upper end rounded pawl leg aperture 24-6.

The operation of the supporting structure to mount and hold cylindrical shaped elements 10 can best be seen in FIG. 1, and as such, will be discussed with reference thereto.

The supporting structure to mount and hold cylindrical shaped elements 10 is placed on a stationary surface 32 with the at least three vertically disposed supporting stand legs 22 resting on the stationary surface 32.

The cylindrical shaped element 12 is placed in the inverted vertically arranged hollow open top frustum-shaped container 14 with the cylindrical shaped element bottom 12-2 resting on the hollow frustum-shaped container bottom inner surface 14-3.

The weight of the cylindrical shaped element 12 causes the optional securing tooth 18 to enter the cylindrical shaped element bottom 12-2 and secures it thereto.

The weight of the cylindrical shaped element 12 further causes the combination of the inverted vertically arranged hollow open top frustum-shaped container 14 and the at least three vertically disposed extension members 20 to slide downwardly on the at least three vertically disposed supporting stand legs 22 in the direction of downward arrow 34.

As the combination of the inverted vertically arranged hollow open top frustum-shaped container 14 and the at least three vertically disposed extension members 20 slide downwardly, each respective locking lever lower end sharp pawl 24-1 moves upwardly along the knurling 16 in the direction of upward arrow 36.

As each respective locking lever lower end sharp pawl 24-1 moves upwardly and by virtue of the upward increasing diameter of the inverted vertically arranged hollow open top frustum-shaped container 14, each respective locking lever lower end sharp pawl 24-1 is displaced outwardly in the direction of outward arrow 38.

The outward movement of each respective locking lever lower end sharp pawl 24-1 causes the at east three crescent-shaped locking levers 24 to pivot upwardly in the direction of pivot arrow 40.

The at least three crescent-shaped locking levers 24 will continue to pivot upwardly until the star wheel locking element perimeter teeth 28-1 contact the cylindrical shaped element outer surface 12-1. At this point each respective locking lever lower end sharp pawl 24-1 will become lodged in the knurling 16 and self-locking the at least three crescent-shaped locking levers 24 from further movement. The cylindrical shaped element 12 is now secured in a stabilized position within the inverted vertically arranged hollow open top frustum-shaped container 14.

When the cylindrical shaped element 12 is to be removed from the inverted vertically arranged hollow open top frustum-shaped container 14, only one readily removable locking lever pivot pin 26 need be removed. After the one readily removable locking lever pivot pin 26 is removed, the respective one of the at least three vertically disposed supporting stand leg 22 is removed from the common slot 23. This will eliminate the stabilizing and holding force of the at least three vertically disposed supporting stand legs and allow the cylindrical shaped element 12 to be readily removed from the inverted vertically arranged hollow open top frustum-shaped container 14.

The allowable diameter of the cylindrical shaped element 12 is directly proportional to, and therefore governed by, the amount of allowable travel the inverted vertically arranged hollow open top frustum-shaped container 14 can make relative to the at least three vertically disposed supporting stand legs 22.

If the cylindrical shaped element 12 is of a resilient material such as the tree trunk of a Christmas tree or the like, the star wheel locking element perimeter teeth 28-1 will pierce the cylindrical shaped element outer surface 12-1 and enter the cylindrical shaped element 12 providing addition securement.

If the cylindrical shaped element 12 is a plant such as a Christmas tree, water can be placed in the inverted hollow frustum-shaped container 14 for nourishment and prevention of dehydration.

It will be understood that each of the elements described above, or two or more together, may also find a useful application in other types of constructions differing from the types described above.

While the invention has been illustrated and described as embodied in a supporting structure to mount and hold cylindrical shaped elements, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A cylindrical shaped element supporting structure, comprising:

a) an inverted vertically arranged hollow open top frustum-shaped container having an inverted vertically arranged hollow open top frustum-shaped container outer surface;

b) knurling circumferentially disposed on said inverted vertically arranged hollow open top frustum-shaped container outer surface;

c) at least three supporting stand legs vertically slidably mounted to said inverted vertically arranged hollow open top frustum-shaped container; and d) at least three crescent-shaped locking levers each of which being vertically pivotally mounted to a respective one of said at least three supporting stand legs and having a crescent-shaped locking lever lower end communicating with said knurling and a crescent-shaped locking lever upper end adapted to communicate with a cylindrical shaped element so that when the cylindrical shaped element is placed in said inverted vertically arranged hollow open top frustum-shaped container the weight of the cylindrical shaped element causes said inverted vertically arranged hollow open top frustum shaped container to slide downwardly along said at least three supporting stand legs which causes said at least three crescent-shaped locking levers to pivot upwardly so as to allow each said crescent-shaped locking lever lower end to ride upwardly and outwardly on said inverted vertically arranged hollow open top frustum-shaped container outer surface until each said crescent-shaped locking lever upper end contacts the cylindrical shaped element and said each said crescent-shaped locking lever lower end engages said knurling and prevents said at least three crescent-shaped locking levers from further pivoting so as to stabilize the cylindrical shaped element in a self-locking fashion.

2. The structure as defined in claim 1, wherein said cylindrical shaped element supporting structure is injection molded from plastic.

3. The structure as defined in claim 1; further comprising a securing tooth disposed in said inverted vertically arranged hollow open top frustum-shaped container.

4. The structure as defined in claim 1; further comprising at least three extension members vertically disposed on said inverted vertically arranged hollow open top frustum-shaped container outer surface and slidably connected to said at least three supporting stand legs.

5. The structure as defined in claim 4, wherein each of said at least three extension members has an extension member arcuate-shaped inner edge that matches said inverted vertically arranged hollow open top frustum-shaped container outer surface, an vertically disposed extension member track portion tongue with flange, and contains a vertically disposed extension member slot.

6. The structure as defined in claim 4, wherein said at least three extension members and said inverted vertically arranged hollow open top frustum-shaped container are integrally formed.

7. The structure as defined in claim 4, wherein each of said at least three supporting stand legs has a supporting stand leg arcuate-shaped upper edge, a supporting stand leg outer block, a vertically disposed supporting stand leg track portion that contains a vertically disposed supporting stand leg track portion groove with recess that slidably receives said vertically disposed extension member track portion tongue with flange.

8. The structure as defined in claim 7, wherein said each of said at least three supporting stand legs further contains a vertically disposed supporting stand leg slot and a horizontally disposed supporting stand leg aperture.

9. The structure as defined in claim 8, wherein each said vertically disposed extension member slot and a respective said vertically disposed supporting stand leg slot is a common slot.

10. The structure as defined in claim 9, wherein each of said at least three crescent-shaped locking levers is vertically pivotally mounted within a respective said common slot.

11. The structure as defined in claim 10, wherein said crescent-shaped locking lever lower end is a sharp pawl.

12. The structure as defined in claim 11, wherein said crescent-shaped locking lever upper end is a rounded pawl that has a pair of rounded pawl legs that are displaced a distance from each other and define an upper pawl slot therebetween.

13. The structure as defined in claim 12, wherein said pair of rounded pawl legs contain aligned horizontally disposed rounded pawl leg apertures.

14. The structure as defined in claim 13; further comprising a star wheel locking element that has star wheel locking element perimeter teeth and is vertically rotatably mounted within said upper pawl slot.

15. The structure as defined in claim 13; further comprising a star wheel rotating pin that passes through said aligned horizontally disposed rounded pawl leg apertures.

16. A method of using a cylindrical shaped element supporting structure, comprising the steps of:

a) placing manually said cylindrical shaped element supporting structure on a stationary surface;

b) resting manually at least three vertically disposed supporting stand legs of said cylindrical shaped element supporting structure on said stationary surface;

c) placing manually a cylindrical shaped element in an inverted vertically arranged hollow open top frustum shaped container of said cylindrical shaped element supporting structure;

d) resting manually the cylindrical shaped element bottom on a hollow frustum-shaped container bottom inner surface of said inverted vertically arranged hollow open top frustum-shaped container;

e) entering automatically a securing tooth disposed on said cylindrical shaped element bottom inner surface into said cylindrical shaped element bottom by virtue of the weight of said cylindrical shaped element;

f) sliding automatically downwardly a combination of said inverted vertically arranged hollow open top frustum shaped container and at least three vertically disposed extension members of said cylindrical shaped element supporting structure on at least three vertically disposed supporting stand legs of said cylindrical shaped element supporting structure by virtue of the weight of said cylindrical shaped element;

g) moving automatically upwardly and outwardly at least three lower locking lever sharp pawls of said cylindrical shaped element supporting structure by virtue of the upward increasing diameter of said inverted vertically arranged hollow open top frustum shaped container;

h) causing automatically at least three crescent-shaped locking levers of said cylindrical shaped element supporting structure to pivot upwardly by virtue of their integral formation with said at least three lower locking lever sharp pawls;

i) pivoting automatically and continuously said at least three crescent-shaped locking levers until star wheel locking element perimeter teeth of said cylindrical shaped element supporting structure contact said cylindrical shaped element;

j) lodging automatically said at least three locking lever sharp pawls in knurling disposed on the outer surface of said inverted vertically arranged hollow open top frustum-shaped container;

k) self-locking automatically said at least three crescent-shaped locking levers from further movement; and l) securing automatically said cylindrical shaped element in a stabilized position in said inverted vertically arranged hollow open top frustum-shaped container.

17. The method as defined in claim 16; further comprising the step of adding a liquid in said inverted vertically arranged hollow open top frustum-shaped container.

18. The method as defined in claim 16; further comprising the step of removing one locking lever pivot pin of said cylindrical shaped element supporting structure after said securing step, when it is required to remove said cylindrical shaped element from said cylindrical shaped element supporting structure.

* * * * *